US005421537A

United States Patent [19]

Cobane et al.

[11] Patent Number: 5,421,537

[45] Date of Patent: Jun. 6, 1995

[54] ENLARGED END CAP ASSEMBLY MADE FROM SMALLER END CAPS

[75] Inventors: Joseph L. Cobane, Grosse Pointe Park; Charles P. Keip, Grandville, both of Mich.

[73] Assignee: Modular Concepts, Inc., Grosse Pointe Woods, Mich.

[21] Appl. No.: 122,121

[22] Filed: Sep. 16, 1993

Related U.S. Application Data

[63] Continuation of Ser. No. 851,985, Mar. 13, 1992, abandoned, which is a continuation-in-part of Ser. No. 592,824, Oct. 4, 1990, Pat. No. 5,100,076.

[51] Int. Cl.[6] ..... B65H 75/14; B65H 75/22; B65H 75/24

[52] U.S. Cl. ..... 242/614; 242/605

[58] Field of Search ..... 242/71.8, 115, 77.1, 242/116, 117, 118.4, 118.6, 118.61, 118.62; 206/391, 413, 414, 415, 416

[56] References Cited

U.S. PATENT DOCUMENTS

| | | | |
|---|---|---|---|
| 930,037 | 8/1909 | Brown | 242/74 |
| 930,327 | 8/1909 | Wheeler | 242/74 |
| T947,001 | 6/1976 | Mavredes | 206/504 |
| 1,187,594 | 6/1916 | Zumvorde | 242/68.5 |
| 1,638,989 | 8/1927 | Duncan | 400/242 |
| 1,875,068 | 8/1932 | Malby | 242/118.61 |
| 1,962,959 | 6/1934 | Kinloch | 242/70 |
| 2,174,049 | 9/1939 | Werner | 24/81 |
| 2,286,500 | 6/1942 | Morrill | 206/59 |
| 2,900,868 | 8/1959 | Gaffney | 242/74 |
| 3,160,356 | 12/1964 | Fisher | 242/18 |
| 3,272,329 | 9/1966 | Mehalov | 206/505 |
| 3,294,225 | 12/1966 | Kenyon | 206/46 |
| 3,356,312 | 12/1967 | Briggs | 242/164 |
| 3,385,678 | 5/1968 | Sorenson | 29/127 |
| 3,390,762 | 7/1968 | Mernieks | 206/59 |
| 3,395,789 | 8/1968 | O'Berry | 206/59 |
| 3,403,780 | 10/1968 | Binkley | 206/65 |
| 3,426,978 | 2/1969 | Barber | 247/74 |
| 3,489,274 | 1/1970 | Hughes | 206/65 |
| 3,495,787 | 2/1970 | Wallace | 242/74.1 |
| 3,593,861 | 7/1971 | Holland | 206/65 R |
| 3,606,002 | 9/1971 | Miller | 206/65 R |
| 3,606,054 | 9/1971 | Miller | 206/65 R |
| 3,814,347 | 6/1974 | Moren | 242/125.1 |
| 4,058,216 | 11/1977 | Tsuyuguchi | 206/391 |
| 4,124,176 | 11/1978 | Carlson et al. | 242/118.62 |
| 4,195,732 | 4/1980 | Bell | 206/391 |
| 4,253,570 | 3/1981 | O'Connor | 206/391 |
| 4,386,704 | 6/1983 | Maillet | 206/391 |
| 4,416,373 | 11/1983 | deLarosiere | 206/503 |
| 4,435,463 | 3/1984 | Roellchen | 206/391 |
| 4,444,311 | 4/1984 | Rias | 206/391 |
| 4,515,323 | 5/1985 | Rood et al. | 242/71.8 |
| 4,667,823 | 5/1987 | Wolfe | 206/392 |
| 4,773,554 | 9/1988 | Warwick | 206/503 |
| 4,832,196 | 5/1989 | Butler | 206/391 |
| 4,877,133 | 10/1989 | Klenter et al. | 206/416 |
| 4,985,316 | 1/1990 | Salloum | 242/71.8 |
| 4,986,486 | 1/1991 | Kemp | 242/74.1 |
| 4,998,619 | 3/1991 | Sowa | 206/392 |
| 5,100,076 | 3/1992 | Cobane et al. | 242/71.8 |

FOREIGN PATENT DOCUMENTS

| | | | |
|---|---|---|---|
| 175983 | 3/1917 | Canada | 242/118.6 |
| 652403 | 3/1929 | France | 242/118.4 |
| 233896 | 5/1925 | United Kingdom | 242/118.6 |
| 433354 | 8/1935 | United Kingdom | 242/71.8 |
| 1174482 | 12/1969 | United Kingdom | 242/71.8 |

*Primary Examiner*—Daniel P. Stodola
*Assistant Examiner*—John Q. Nguyen
*Attorney, Agent, or Firm*—Barnes, Kisselle, Raisch, Choate, Whittemore & Hulbert

[57] ABSTRACT

An end cap has a central coupling for securing it to one end of a core on which a length of flexible material is adapted to be wound. The end cap has a partial coupling formation along one edge so that it can be assembled edge-to-edge with one or more additional end caps of identical construction to form an enlarged end cap unit in which the partial coupling formations combine to form a second coupling for securing the enlarged end cap unit to one end of a core. A locking device is also provided for releasably locking the core to an end cap.

14 Claims, 3 Drawing Sheets

ENLARGED END CAP ASSEMBLY MADE FROM SMALLER END CAPS

This application is a continuation of prior application Ser. No. 07/851,985, filed Mar. 13, 1992, now abandoned, which was a contiuation-in-part of application Ser. No. 07/592,824, filed Oct. 4, 1990, now U.S. Pat. No. 5,100,076.

BACKGROUND AND SUMMARY OF THE INVENTION

In our prior application Ser. No. 07/592,824, there is disclosed a fabric roll having an elongated core and an end cap releasably attached to each end of the core. A length of fabric or like material can be wound on the core to a diameter usually not exceeding the diameter or radial extent of the end caps. To wind the fabric to a larger diameter requires the substitution of larger end caps. However, to maintain an inventory of end caps of different sizes obviously is very costly.

In accordance with the present invention, a larger end cap can be built up from an assembly of smaller end caps. Thus end caps of a given size may be used singly for the smaller diameter rolls of fabric or the like and may be combined with one or more additional end caps to provide an enlarged end cap unit for larger diameter rolls.

In accordance with the present invention, and as more specifically described hereinafter, an end cap may have a central coupling for securing it to one end of a core. The end cap may also have a partial coupling formation along one edge. The end cap is adapted to be assembled edge-to-edge with one or more additional end caps of identical construction to form an enlarged end cap unit in which the partial coupling formations combine to form a second coupling for securing the end cap unit to one end of the core. Thus the core may be used with a single end cap at each end for small rolls of fabric or it may be used with one or more additional end caps assembled edge-to-edge into an enlarged end cap unit at each end for larger diameter rolls.

It is an object of this invention to provide specially designed end caps having the features referred to above.

Another object of the invention to provide an improved locking device for releasably securing an end cap to the core.

A further object is to provide a fabric roll which is rugged and durable, relatively inexpensive, and easy to manufacture, assemble and disassemble.

Other objects, features and advantages of the invention will become more apparent as the following description proceeds, especially when considered with the accompanying drawings.

DETAILED DESCRIPTION

Figure 2A:
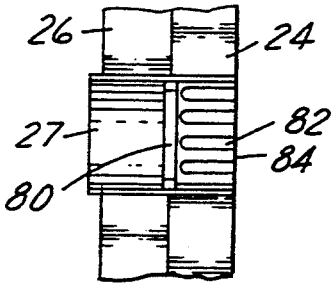
FIG. 2A is a fragmentary view of the end cap looking in the direction of the arrow 2A in FIG. 2.
Figure 1:
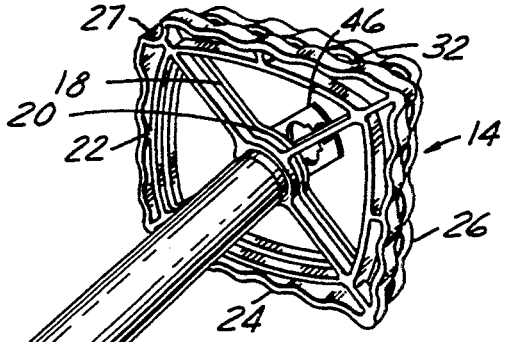
FIG. 1 is an exploded view in perspective of a roll constructed in accordance with the invention having a core on which a given width of film or web or fabric or like material may be wound, with end caps releasably secured to the ends of the core.
Figure 2:
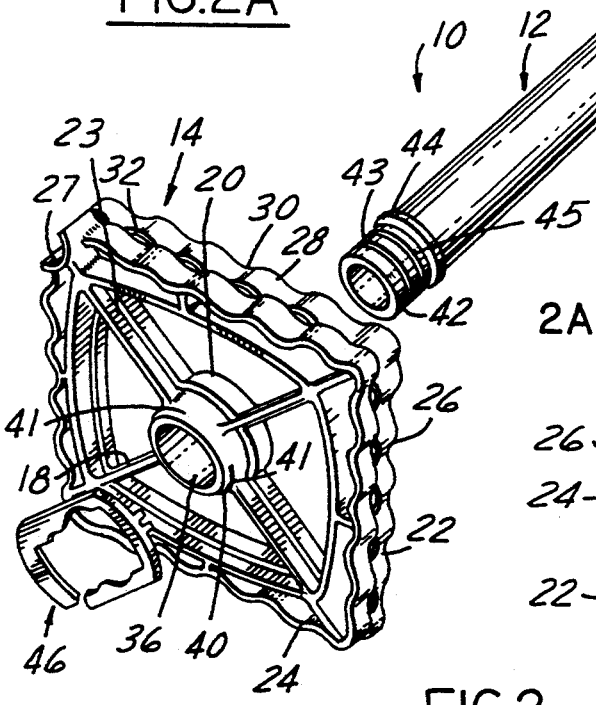
FIG. 2 is an elevational view of an end cap.

Referring now more particularly to the drawings, and especially to FIGS. 1 and 2 thereof, the roll 10 comprises an elongated core 12 and an end cap 14 at each end of the core.

The core 12 preferably is in the form of a cylindrical tube which may be of substantially uniform circular cross-section throughout most of its length or may have corrugations in the mid-portion extending lengthwise thereof to strengthen the core.

The end caps 14 are identical discs, preferably square, each having a body portion 16 composed of radially extending spokes or struts 18 connected at their inner ends to a central axially extending hub 20 which serves as a coupling for releasably securing the end cap to the core. The struts 18 are connected at their outer ends to a rim 22. Each strut 18 has a narrow rib 23 extending lengthwise thereof. The body of the end cap between the struts is preferably open for purposes of weight reduction.

The rim 22 of the end cap is preferably generally square and has an axially inner peripheral surface portion 24 and an axially outer peripheral surface portion 26 both of which face radially outwardly. These inner and outer peripheral surface portions preferably extend throughout the entire periphery of the end cap in an undulating pattern, except at one corner where a partial coupling formation 27, which will be described more fully hereinafter, is provided.

The inner and outer peripheral surface portions 24 and 26 each consist of alternately outwardly bulging and inwardly recessed surface segments 28 and 30. These bulging and recessed surface segments are preferably of arcuate form and blend together in a generally sine-wave configuration. The wave patterns of the two peripheral surface portions 24 and 26 are 180° out of phase so that the bulges and recesses of one are respectively opposite the recesses and bulges of the other.

The bulging and recessed surface segments of the inner peripheral surface portion 24 of each end cap are connected to the recessed and bulging surface segments, respectively, of the outer peripheral surface portion 26 by linking surfaces 32 which are disposed at a designated angle to the axis of the end cap, typically less than 90° and preferably about 45°.

The hub 20 of each end cap has an internal surface 36 which may be cylindrical and of uniform circular cross-section throughout its length or which may have a portion thereof provided with circumferentially spaced, axially extending reliefs 37 adjacent the inner end 38 thereof. An annular flange 39, of larger internal diameter than the hub, extends axially outwardly from end 38 thereof. The hub 20 has a tubular portion 40 extending axially outwardly beyond the outer end of the hub in which are formed a pair of diametrically opposed, circumferentially extending slots 41.

The core 12 has a portion 42 at each end adapted to telescope within the hub 20 of an end cap. The radially outer surfaces of the end portions 42 are cylindrical and fit snuggly with the hubs 20 of the end caps 14. Each end portion 42 has near its outer end an annular groove 43, and axially inwardly thereof a radially outwardly extending annular abutment 44. Each end portion 42 has an annular groove 45 between groove 43 and abutment 44. When assembling an end cap 14 on the end of a core 12, the end portion 42 of the core extends into the hub 20 and assumes a position in which the abutment 44 engages the inner end 38 of the hub and the annular groove 43 registers with the slots 41. In this position, the end cap is perpendicular to the core.

A locking device 46 is provided to releasably secure each end cap 14 to the core 12. The locking device is made of a flexible, resilient material and is generally rectangular, having laterally spaced, generally parallel side bars 48 and 50 and longitudinally spaced end bars 52 and 54. The side and end bars are integrally connected end-to-end except for the gap 56 between the adjacent ends of the side bar 50 and end bar 54.

The laterally inner edges of the side bars 48 and 50 have a first set of opposed arcuate recesses 60 and 62 near one end bar 52, and a second set of opposed, arcuate recesses 64 and 66 near the other end bar 54. The recesses 60 and 62 are cut more deeply into the side bars than are the recesses 64 and 66 and hence recesses 60 and 62 are spaced apart farther than recesses 64 and 66.

On one side of the end bar 52 of the locking device, there are two longitudinally extending guides 70 which are spaced apart a distance slightly greater than the width of a rib 23 on the strut of an end cap to engage and be guided thereby.

In the normal, relaxed or unflexed condition of the locking device 46, the side bars are spaced apart a distance less than the outside diameter of the tubular portion 40 of the hub 20 of the end cap.

The core 12 is assembled with an end cap 14 by inserting one end portion 42 of the core into the hub 20 of the end cap until the abutment 44 contacts the inner end 38 of the hub and the annular groove 43 registers with the slots 41 in the tubular portion 40 of the hub. The locking device 46 is flexed and stretched over the tubular portion 40 and turned so that the side bars 48 and 50 register with the hub slots 41 and the guides 70 straddle one of the ribs 23, as shown. The gap 56 facilitates the stretching and turning of the locking device.

The locking device can slide lengthwise, that is parallel to its side bars 48 and 50, between the limits established by the end bars 52 and 54.

Figure 3:
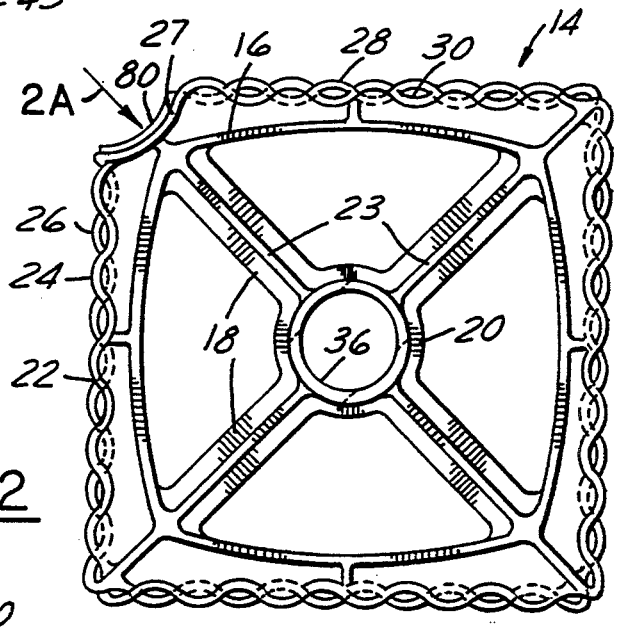
FIG. 3 is a fragmentary view with parts in section showing an improved locking device for releasably connecting the end cap and core, with the locking device in the locking position.
Figure 4:
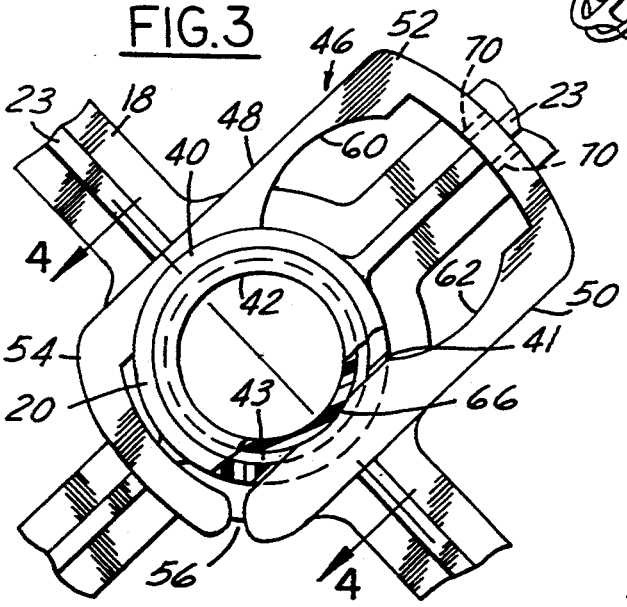
FIG. 4 is a sectional view taken on the line 4—4 in FIG. 3.
Figure 4:
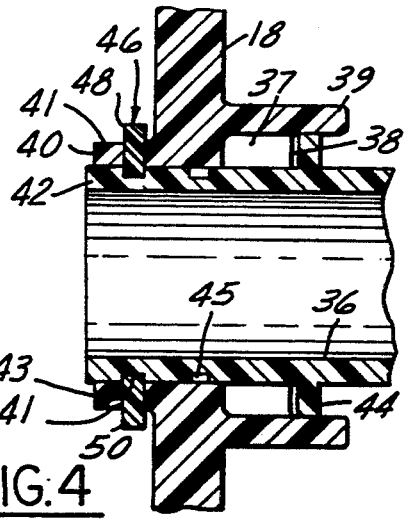
Figure 5:
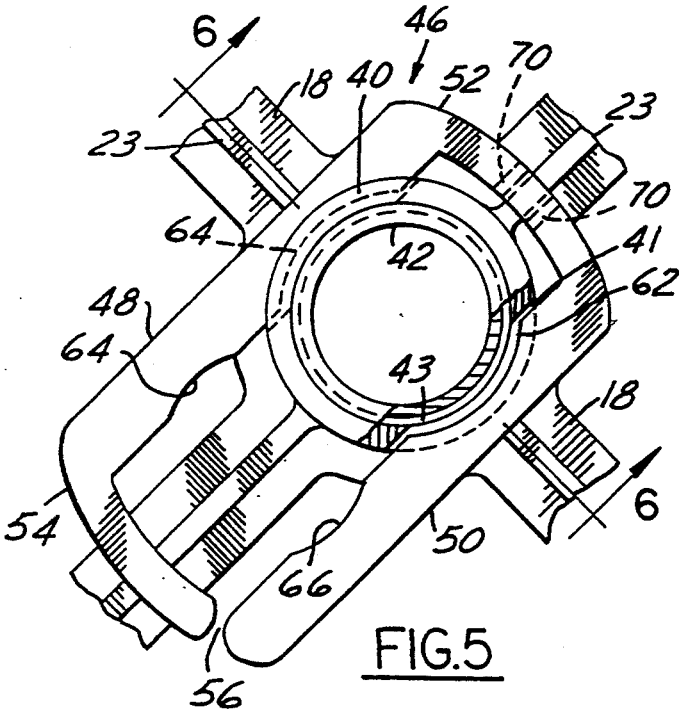
FIG. 5 is similar to FIG. 3 but shows the locking device in the unlocked position.
Figure 6:
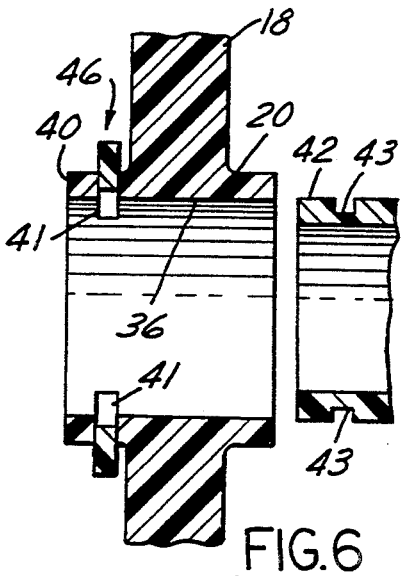
FIG. 6 is a sectional view taken on the line 6—6 in FIG. 5.

The locking device 46 may be slid in one direction to align recesses 64 and 66 with the slots 41, in which case the recesses 64 and 66 project through the slots 41 and into the groove 43 to releasably lock the end cap on the core (FIGS. 3 and 4). The locking device may be slid in the opposite direction to align recesses 60 and 62 with slots 41, in which case recesses 60 and 62 project into the slots 41 but, because they are cut more deeply, they do not project into groove 43 (FIGS. 5 and 6). Hence in this latter position of the locking device 46, the end cap is released from the core and may be separated and removed from the core. The guides 70, by straddling a rib 23 on a strut 18 of an end cap, insure that the side bars 48 and 50 are always in register with the slots 41.

The locking device will remain attached to the hub of the end cap and will not accidentally become separated therefrom even after the end cap has been removed from the core, because the side bars in all positions of the locking device register with and project into the slots 41. The locking device is sufficiently flexible and so dimensioned that it will resiliently hug the tubular portion 40 of the hub 20 with yielding pressure at all times.

Fabric or like material F may be wound on the core of a roll between the end caps. Because the grooves 43 in the core are endless, the core 12 can rotate even while locked to the end caps by the locking devices 46, thereby facilitating winding and unwinding the material F onto and off the core.

Figure 7:
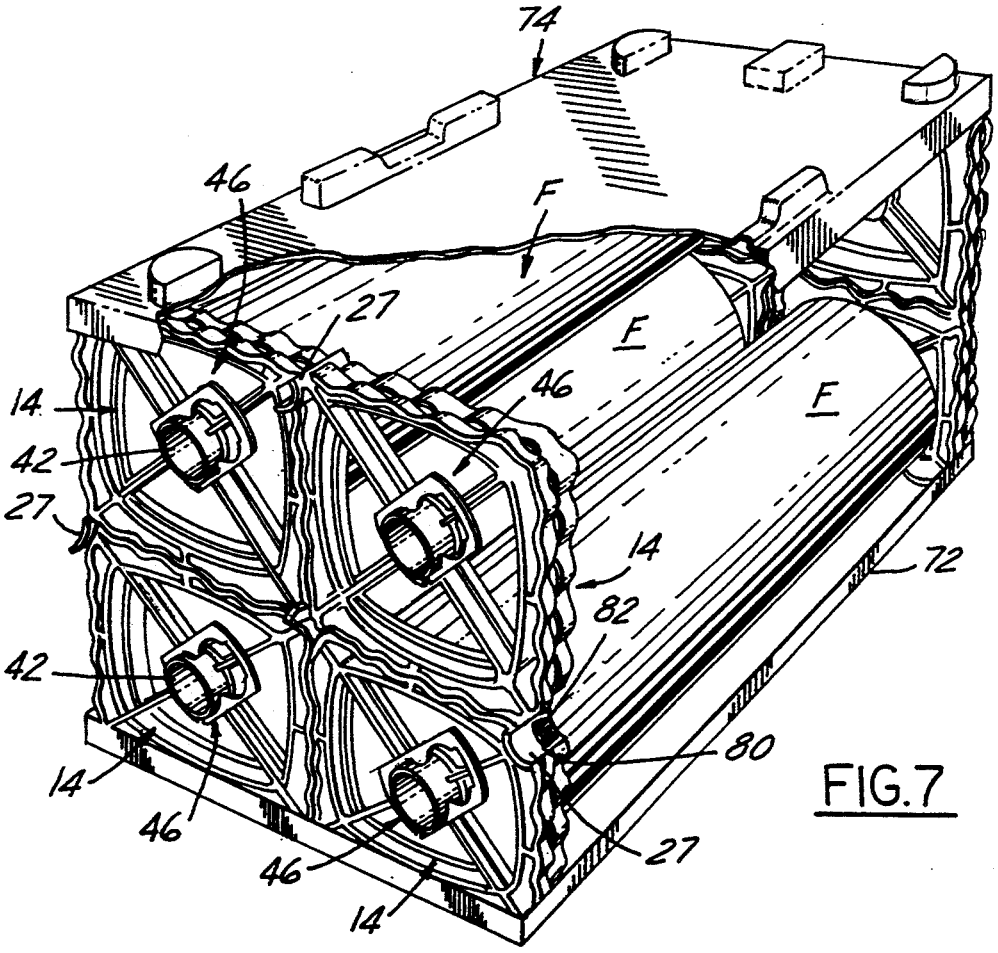
FIG. 7 is a perspective view with parts broken away, showing a module formed of a plurality of fabric rolls in which the end caps are interfitted with one another, with top and bottom pallets completing the module.
Figure 11:
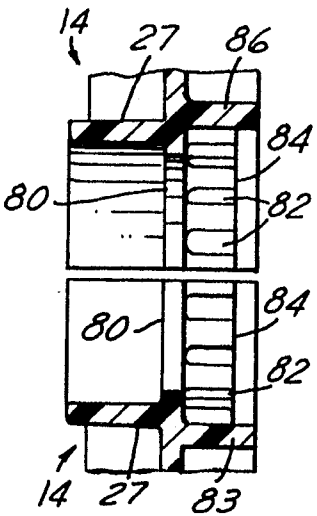
FIG. 11 is also taken on the line 10—10 in FIG. 9, but with the core omitted.
Figure 10:
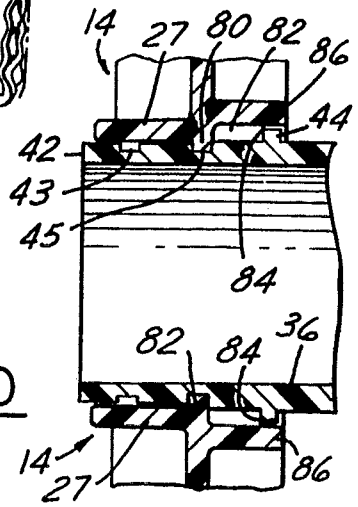
FIG. 10 is a view taken on the line 10—10 in FIG. 9.

Referring to FIG. 7, rolls with film or fabric wound on the core can be brought together into a module by arranging the wound rolls so that the cores are parallel and the end caps are in edge-to-edge contact. The wavy edge portions 24 and 26 interfit with one another and, being out of phase, prevent longitudinal and lateral shifting. Any number of fabric wound rolls may be bundled or grouped together. For example, a module may be composed of two rows wide and two rows high of wound rolls as in FIG. 7 or three or more rolls wide and three or more rolls high. The edge-to-edge interfit is clearly shown in FIG. 7.

The module is completed by a bottom pallet 72 supporting the bottom row of rolls and a top pallet 73 over the top row of rolls, and one or more bands, not shown, around the pallets to bind the rolls and pallets of the module together.

Figure 8:
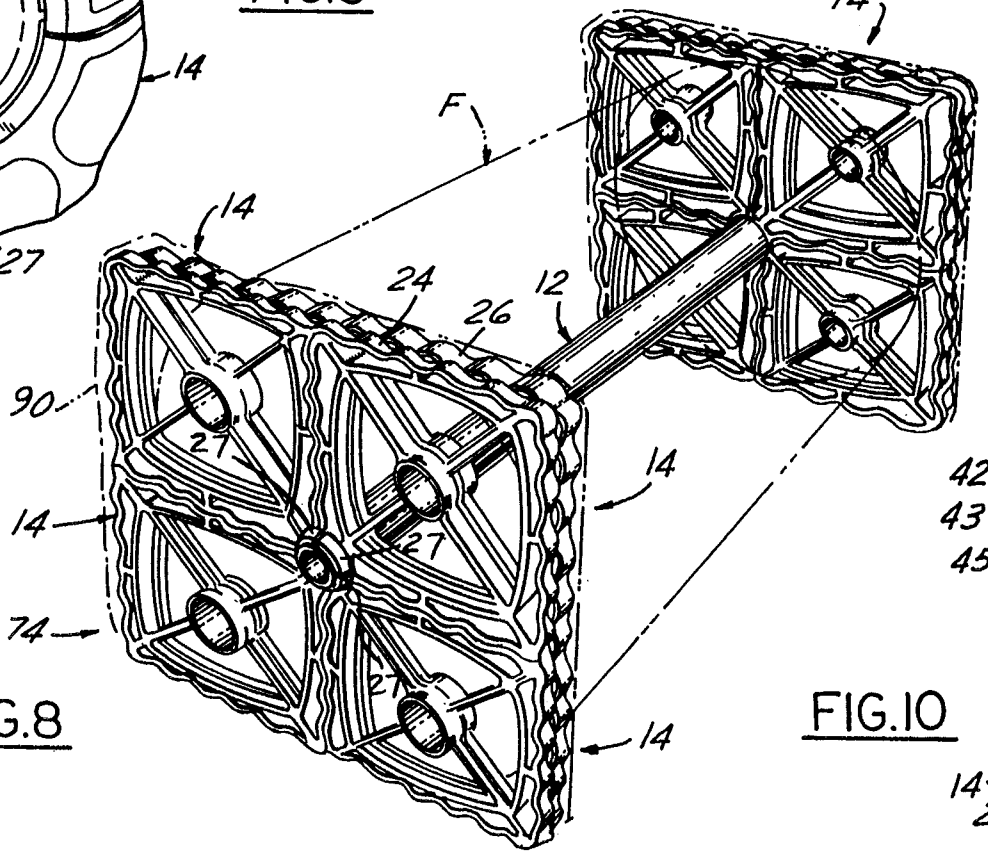
FIG. 8 is a view in perspective showing four end caps at each end of a single core arranged edge-to-edge to form an enlarged end cap unit so that a larger diameter roll of fabric can be wound on the core.

As stated above, an end cap 14 can be combined or assembled edge-to-edge with one or more additional end caps of identical construction to provide an enlarged end cap assembly 74. FIG. 8 shows four end caps 14 assembled together edge-to-edge with the wavy edge portions 24 and 26 interfitting in the same manner as in FIG. 7, except that in FIG. 8 the four end caps are turned so that the partial coupling formations 27 are at the center of the end cap assembly 74. These partial coupling formations 27 are arcuate and substantially 90° in circumferential extent. When the four end caps 14 are assembled as in FIG. 8 the partial coupling formations cooperate with one another to form a second cylindrical coupling 76 similar to the coupling or hub 20. Each of the partial coupling formations 27 has a circumferentially extending radially inwardly extending rib 80. When the four end caps 14 are assembled as in FIG. 8, the four ribs 80 substantially abut in an end-to-end relationship and form a complete circle which is interrupted only where the ends substantially abut at 81. The inner surface of each partial coupling formation preferably has circumferentially spaced, axially extending reliefs 82 extending from rib 80 to the inner end 84. An annular flange 86 of enlarged internal diameter extends axially inwardly from inner end 84.

The ends of the core 12 are shown extending into the couplings 76 provided by the end cap assembly 74, with abutments 44 engaging the inner ends 84 of the partial coupling formations 27. The core is prevented from pulling out of the couplings 76 of the end cap assembly 74 by the ribs 80 which extend into grooves 45 in the ends of the core. The four end caps 14 forming each end cap assembly 74 are held together by any suitable means, as by a strap or belt partially shown by broken lines 90 in FIG. 8.

Figure 9:
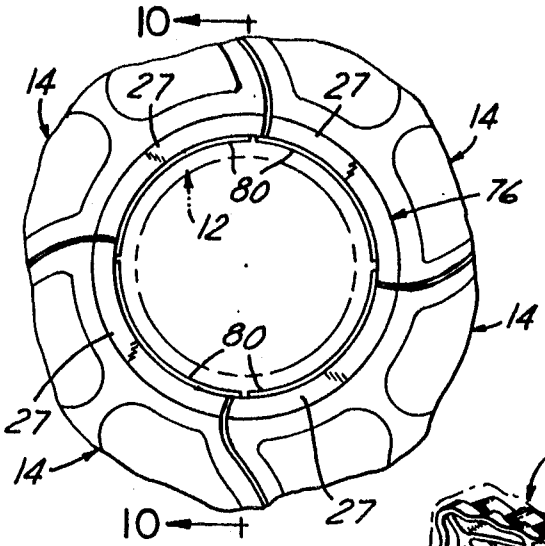
FIG. 9 is an enlarged fragmentary elevational view showing the coupling at the center of an enlarged end cap unit formed by the partial coupling formations on the individual end caps making up the enlarged end cap unit, and showing a core in broken lines.

The core 12 is assembled with each end cap assembly 74 by first combining only two adjacent end caps 14, for example the bottom two in FIG. 9, then introducing the core by laying and end thereof into the saddle-like receptacle provided by the two partial coupling formations 27, with the groove 45 receiving the ribs 80, and thereafter assembling the upper two end caps 14 over the end of the core so that the ribs 80 thereof are also received in the groove 45. Finally the strap or belt 90 is applied.

What is claimed is:

1. An enlarged end cap assembly comprising a plurality of end caps, each end cap having a minimum diameter and being smaller in size than said end cap assembly, said end cap assembly being formed by having the end caps thereof assembled together in edge-to-edge relation, said end cap assembly having a first central coupling adapted to engage with one end of an elongated core on which a relatively large roll of flexible strip material, larger in diameter than the minimum diameter of each end cap, is wound, each end cap having a partial coupling formation, said partial coupling formations combining to form said first coupling, each end cap having a second central coupling adapted to engage with one end of an elongated core on which a relatively small roll of flexible strip material, smaller in diameter than the minimum diameter of each end cap, is wound.

2. An enlarged end cap assembly as defined in claim 1, wherein each of said end caps is rectangular in shape.

3. An enlarged end cap assembly as defined in claim 1, wherein each of said end caps is square in shape.

4. An enlarged end cap assembly as defined in claim 1, wherein said end caps are identical in shape.

5. An enlarged end cap assembly as defined in claim 1, wherein each of said partial coupling formations is located at a corner of each of said end caps.

6. An enlarged end cap assembly as defined in claim 1, wherein said first and second couplings are cylindrical, and said partial coupling formations are arcuate.

7. An enlarged end cap assembly as defined in claim 1, wherein each of said end caps is square in shape, each of said partial coupling formations is located at a corner of each said end caps, said second central coupling of each end cap is cylindrical, and each of said partial coupling formations is arcuate and said first central coupling formed by a combination of said arcuate partial coupling formations is cylindrical.

8. An enlarged end cap assembly as defined in claim 1, wherein each end cap has a central axis, each end cap having a generally polygonal radially outer perimeter including an axially inner polygonal peripheral surface portion and an axially outer polygonal peripheral surface portion, said inner and outer polygonal peripheral surface portions of each end cap facing radially outwardly and extending at least throughout a portion of the perimeter thereof in an undulating pattern consisting of alternately outwardly bulging and inwardly recessed surface segments, said axially inner and outer peripheral surface portions of each end cap being offset peripherally with respect to each other so that said bulging and recessed segments of one of said peripheral surface portions of each end cap are non-aligned axially with respect to said bulging and recessed segments of the other of said peripheral surface portions thereof, in the aforesaid edge-to-edge relation of the end caps, the bulging and recessed surface segments of said axially inner and outer peripheral surface portions thereof interfitting with one another and said outwardly bulging surface segments resisting relative axial movement therebetween.

9. An enlarged end cap assembly as defined in claim 8, wherein each of said end caps is rectangular in shape.

10. An enlarged end cap assembly as defined in claim 8, wherein each of said end caps is square in shape.

11. An enlarged end cap assembly as defined in claim 8, wherein said end caps are identical in shape.

12. An enlarged end cap assembly as defined in claim 8, wherein each of said partial coupling formations is located at a corner of each of said end caps.

13. An enlarged end cap assembly as defined in claim 8, wherein said first and second couplings are cylindrical and said partial coupling formations are arcuate.

14. An enlarged end cap assembly as defined in claim 8, wherein each of said end caps is square in shape, each of said partial coupling formations is located at a corner of each of said end caps, said second central coupling of each end cap is cylindrical, and each of said partial coupling formations is arcuate and said first central coupling formed by a combination of said arcuate partial coupling formations is cylindrical.

* * * * *